US005915425A

United States Patent [19]

Nilsson et al.

[11] Patent Number: 5,915,425

[45] Date of Patent: Jun. 29, 1999

[54] CABLE TIE INSTALLATION TOOL

[75] Inventors: Mikael Nilsson; Mats Norin; Nils Isaksson, all of Alvdalen, Sweden

[73] Assignee: Thomas & Betts Corporation, Memphis, Tenn.

[21] Appl. No.: 08/919,927

[22] Filed: Aug. 28, 1997

Related U.S. Application Data

[ 60] Provisional application No. 60/024,816, Aug. 28, 1996.

[51] Int. Cl.[6] ..... B21F 9/02

[52] U.S. Cl. ..... 140/123.6; 140/93.2

[58] Field of Search ..... 140/93 A, 93.2, 140/123.6

[56] References Cited

U.S. PATENT DOCUMENTS

| | | |
|---|---|---|
| Re. 29,973 | 4/1979 | Paradis . |
| Re. 30,996 | 7/1982 | Pobuta et al. . |
| 1,196,900 | 9/1916 | Taylor . |
| 2,685,130 | 8/1954 | Tibbets . |
| 2,713,279 | 7/1955 | Harris . |
| 2,889,730 | 6/1959 | Reiniger . |
| 3,130,765 | 4/1964 | Neuschotz . |
| 3,168,119 | 2/1965 | Schwester et al. . |
| 3,254,680 | 6/1966 | Caveney et al. . |
| 3,284,076 | 11/1966 | Gibson . |
| 3,332,454 | 7/1967 | Lawson et al. . |
| 3,344,815 | 10/1967 | Lawson et al. . |
| 3,433,275 | 3/1969 | Eppler . |
| 3,438,406 | 4/1969 | Rozmus . |
| 3,589,406 | 6/1971 | Moberg . |
| 3,610,296 | 10/1971 | Kabel . |
| 3,645,302 | 2/1972 | Caveney et al. . |
| 3,661,187 | 5/1972 | Caveney et al. . |
| 3,712,346 | 1/1973 | Noorily . |
| 3,735,784 | 5/1973 | Obuch et al. . |
| 3,752,199 | 8/1973 | Fekete . |
| 3,782,426 | 1/1974 | Morgan et al. . |
| 3,830,263 | 8/1974 | Benfer . |
| 3,853,155 | 12/1974 | Kabel . |
| 3,865,156 | 2/1975 | Moody et al. . |
| 3,993,109 | 11/1976 | Fortsch . |
| 4,047,545 | 9/1977 | Paradis . |
| 4,064,918 | 12/1977 | Pobuta et al. . |
| 4,081,002 | 3/1978 | Violi . |
| 4,093,005 | 6/1978 | Eberhardt et al. . |
| 4,129,157 | 12/1978 | Sciolotto . |
| 4,144,737 | 3/1979 | Izraeli . |
| 4,192,358 | 3/1980 | Bone . |
| 4,390,047 | 6/1983 | Kaneko . |
| 4,410,019 | 10/1983 | Suzuki . |
| 4,499,928 | 2/1985 | Furutsu . |
| 4,548,242 | 10/1985 | Paradis . |
| 4,793,385 | 12/1988 | Dyer et al. . |
| 4,997,011 | 3/1991 | Dyer et al. . |
| 5,048,575 | 9/1991 | Smith . |
| 5,065,798 | 11/1991 | Alletto et al. . |
| 5,159,757 | 11/1992 | Weid et al. . |
| 5,167,265 | 12/1992 | Sakamoto . |
| 5,392,822 | 2/1995 | Kraus . |
| 5,492,156 | 2/1996 | Dyer et al. . |
| 5,597,018 | 1/1997 | Shipman . |
| 5,630,450 | 5/1997 | Kurmis et al. . |
| 5,632,312 | 5/1997 | Hoffman . |
| 5,769,133 | 6/1998 | Dyer et al. . |

FOREIGN PATENT DOCUMENTS

| | | |
|---|---|---|
| 0 299 387 | 1/1989 | European Pat. Off. . |
| 7315796 | 11/1973 | Sweden . |
| 7701221 | 2/1977 | Sweden . |
| 2 172 360 | 9/1986 | United Kingdom . |

*Primary Examiner*—Lowell A. Larson
*Attorney, Agent, or Firm*—Hoffmann & Baron, LLP

[57] ABSTRACT

A tool for installation of a cable tie. The tool includes a tensioning mechanism for tensioning the cable tie to a predetermined tension setting and a cutting mechanism for severing an excess portion of the tail from the tensioned cable tie. The tool provides grip size adjustability to reduce operator fatigue, angular nose adjustability to facilitate installation of cable ties in a variety of orientations with respect to the installer's work station, and reduced recoil shock/vibration. The tool further provides rapid adjustability of the tension setting level, allows the installer to readily view the tension setting level and provides an adjustable tension setting mechanism which resists damage due to impact/jarring of the tool and exposure to dirt and other environmental conditions.

37 Claims, 16 Drawing Sheets

CABLE TIE INSTALLATION TOOL

This application claims the benefit of U.S. Provisional Application No. 60/024,816 filed on Aug. 28, 1996.

BACKGROUND OF THE INVENTION

The present invention relates to a cable tie installation tool and, more particularly, to an improved tool for tensioning and cutting of cable ties.

As is well known to those skilled in the art, cable ties (or straps) are used to bundle or secure a group of articles such as electrical wires or cables. Cable ties of conventional construction include a cable tie head and an elongate tail extending therefrom. The tail is wrapped around a bundle of articles and thereafter inserted through a passage in the head. The head of the cable tie typically supports a locking element which extends into the head passage and engages the body of the tail to secure the tail to the head.

In practice, the installer manually places the tie about the articles to be bundled, inserts the tail through the head passage and then manually tightens the tie about the bundle. At this point, a cable tie installation tool is used to tension the cable tie to a predetermined tension. One or more trigger strokes may be needed to sufficiently tension the tie depending upon how tightly the installer manually tensions such tie. Once the strap tension approaches the predetermined tension setting level, the tool severs the excess tail portion from the tie, i.e., that portion of the tail which extends beyond the head of the cable tie.

The tools of the prior art, although capable of tensioning and thereafter cutting the excess tail portion of the cable tie, typically have several disadvantages associated therewith which, either singularly or plurally, may lead to operator fatigue. For example, prior art installation tools are manufactured with a fixed-sized grip. As a result, an operator with a smaller hand must use the same tool as an operator with a larger hand. Thus, it is likely that neither operator will be comfortable with the grip size of the tool, such discomfort eventually leading to operator fatigue after numerous applications. Moreover, prior art tools are typically formed with the nose portion being angularly fixed with respect to the housing and trigger portions. As a result, the operator must often angularly manipulate the tool itself to tension cable ties which are installed in rotated orientations. This need to manipulate the tool forces the operator to install cable ties with the tool in an ergonomically unnatural and/or uncomfortable orientation, again leading to operator fatigue after numerous applications.

Additionally, prior art installation tools typically produce recoil shock and vibration upon the severing of the cable tie tail of the installed cable tie. This shock/vibration is transmitted back to the installer through the handle and/or trigger mechanism of the tool. The recoil shock/vibration also leads to fatigue of the installer during repeated use of the tool. In certain applications, the recoil shock/vibration could even lead to damage to the tool and/or injury to the installer. Finally, prior art installation tools typically include adjustable tensioning mechanisms which i) are difficult to adjust in that such mechanisms typically require plural turns of a tension adjusting screw to vary the tension setting in the tool, ii) are difficult to read during use, and/or iii) are susceptible to damage from dropping/jarring of the tool and exposure to dirt and other environmental conditions.

There is therefor a need in the art for an installation tool which limits and/or eliminates operator fatigue by 1) providing grip size adjustability, 2) providing angular nose adjustability to facilitate installation of cable ties in a variety of orientations with respect to the installer's work station, and 3) reducing and/or eliminating recoil shock/vibration experienced during severing of the cable tie tail from the installed cable tie. There is a further need in the art for a cable tie installation tool which provides rapid adjustability of the tension setting level, allows the installer to readily view the tension setting level and provides an adjustable tension setting mechanism which resists damage due to impact/jarring of the tool and exposure to dirt and other environmental conditions.

SUMMARY OF THE INVENTION

The present invention, which addresses the needs of the prior art, relates to a tool for installation of a cable tie. A cable tie includes a head and an elongate tail extending therefrom. The tool includes a generally pistol-shaped housing. The housing operatively supports a tensioning mechanism for tensioning the cable tie to a predetermined tension setting and a cutting mechanism for severing the excess portion of the tail from the tensioned cable tie. The housing includes a fixed grip and a movably mounted trigger cooperating with the grip whereby movement of the trigger with respect to the grip operates the tensioning and cutting mechanisms. The grip and trigger are spaced a distance from one another thus defining a grip size which is encountered by a hand of an installer. The trigger is adjustable with respect to the grip to vary the distance therebetween thus varying the grip size to facilitate use of the tool by various installers.

The present invention further relates to a tool for installation of a cable tie including a housing and a nose portion carried by the housing. The nose portion includes a tensioning mechanism for tensioning the cable tie and further includes a cutting mechanism for severing an excess portion of the tail from the tensioned cable tie. The tool includes a trigger mounted to the housing for operating the tensioning and cutting mechanisms. Finally, the nose portion is rotatable with respect to the housing to allow ready installation of rotated cable ties while maintaining the tool in an ergonomically comfortable orientation.

The present invention further relates to a tool for installation of a cable tie including a housing operatively supporting a tensioning mechanism for tensioning the cable tie to a predetermined tension setting and a cutting mechanism for severing an excess portion of the tail from the tensioned cable tie. The tool includes a trigger mounted to the housing for operating the tensioning and cutting mechanisms. Finally, the tool includes means for temporarily securing the tensioning and cutting mechanisms together during severing of the excess portion of the tail from the cable tie to prevent further tensioning of the cable tie and to eliminate recoil of the tensioning mechanism.

Finally, the present invention relates to a tool for installation of a cable tie including a housing operatively supporting a tensioning mechanism for tensioning the cable tie to a predetermined tension setting and a cutting mechanism for severing an excess portion of the tail from the tensioned cable tie. The tool includes a trigger mounted to the housing for operating the tensioning and cutting mechanisms. The tool further includes a generally U-shaped tension spring for applying a predetermined amount of resistance to the tensioning mechanism to allow tensioning of the cable tie to a predetermined tension setting. Finally, the tool includes a tension adjustment ring carried by the housing and having a plurality of sets of opposing contact surfaces which cooperate with the tension spring. Each of the sets corresponds to a predetermined tension setting whereby rotation of the ring adjusts the tension setting in the tool.

As a result, the present invention provides an installation tool which limits and/or eliminates operator fatigue by 1) providing grip size adjustability, 2) providing angular nose adjustability to facilitate installation of cable ties in a variety of orientations in respect to the installer's work station and 3) reducing and/or eliminating recoil shock/vibration experienced during severing of the cable tie tail from the installed cable tie. The tool of the present invention further provides rapid adjustability of the tension setting level, allows the installer to readily review the tensioning level and provides an adjustable tension setting mechanism which resists damage to the impact/drawing of the tool and exposure to dirt and other environmental conditions.

DETAILED DESCRIPTION OF THE INVENTION

Figure 1:
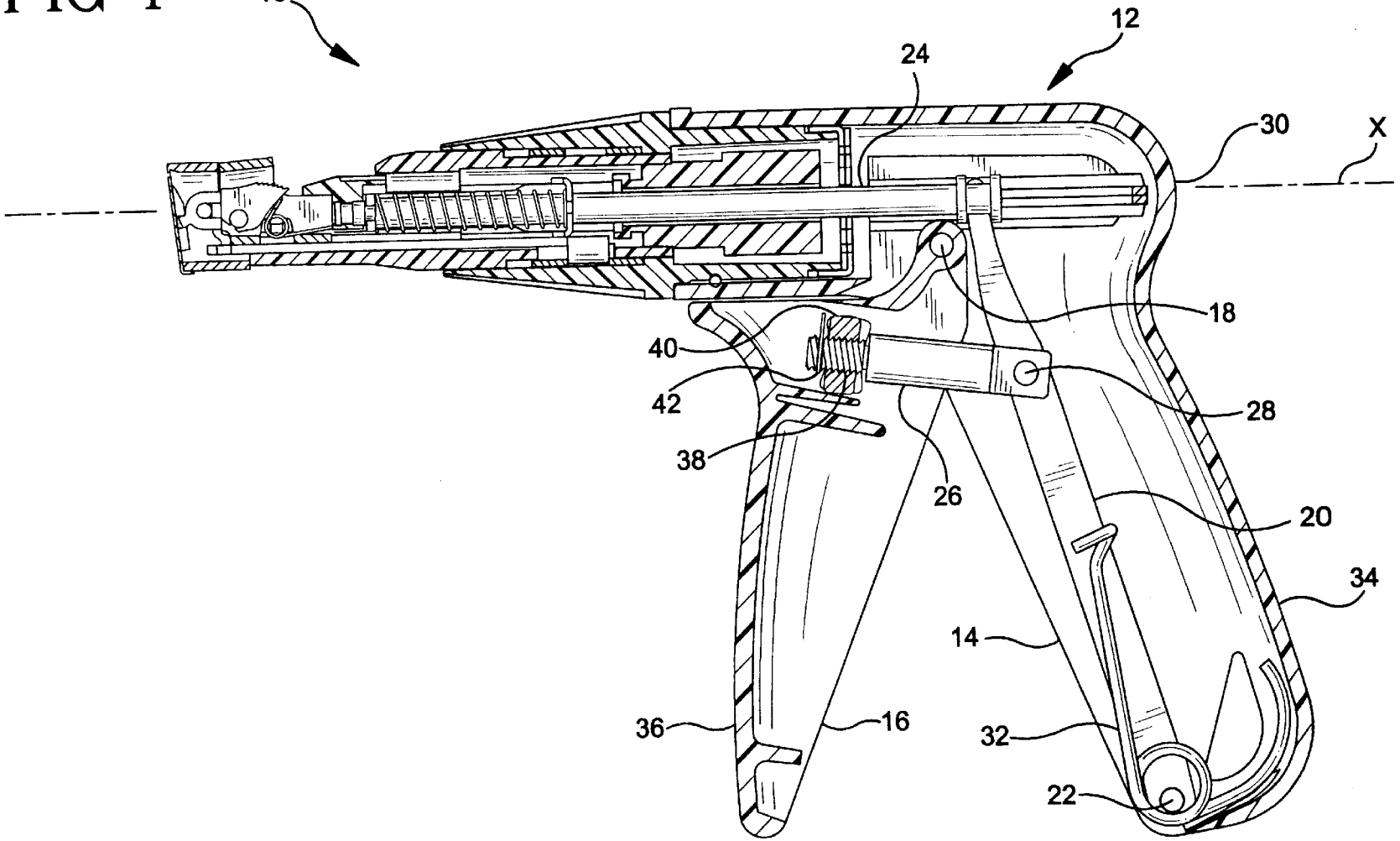
FIG. 1 is an elevational view in section of the tool of the present invention.
Figure 1A:
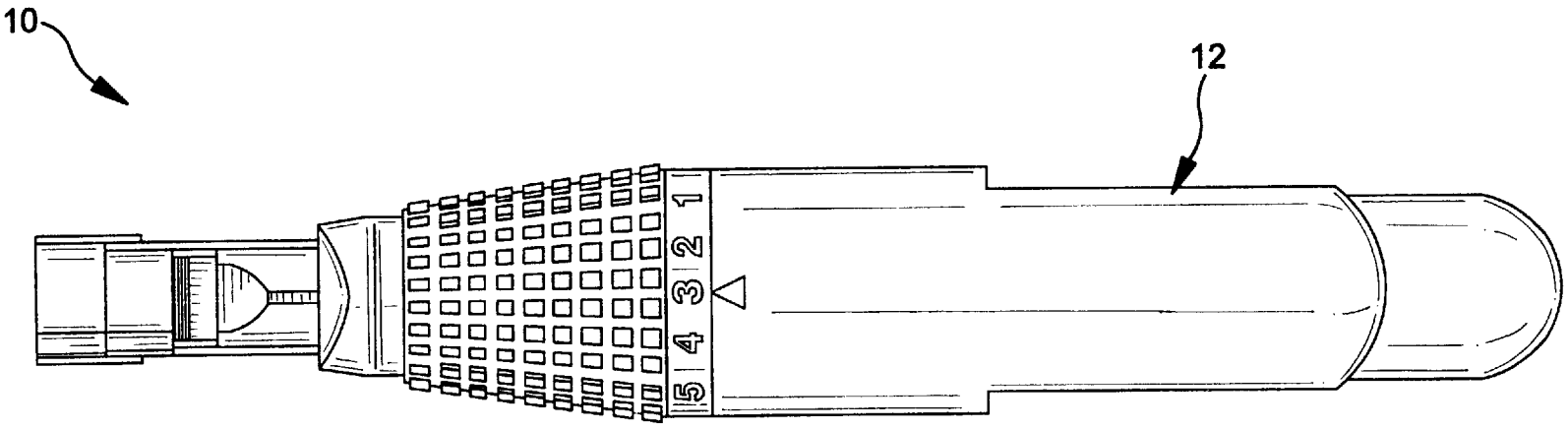
FIG. 1*a* is a top view of the tool of FIG. 1.

An installation tool 10 for tensioning and cutting of cable ties is shown in FIG. 1. Tool 10 includes a pistol-shaped housing 12 terminating in a fixed grip 14. A trigger 16 is pivotally mounted to housing 12 via pin 18. A linkage assembly 20 is pivotally mounted to grip 14 by a pin 22. The opposing end of linkage assembly 20 mechanically cooperates with an axially-reciprocating actuating rod 24.

A connecting shaft 26 is non-slidably mounted to the trigger on one of its ends and is pivotally mounted to linkage assembly 20 via connecting pin 28 on the other of its ends whereby squeezing of trigger 16 causes pivoting of such trigger about pin 18 thus causing rotation of linkage assembly 20 about pin 22. Rotation of linkage assembly 20 about pin 22 in turn causes actuating rod 24 to move axially along axis X. With respect to the orientation of the components shown in FIG. 1, squeezing of trigger 16 causes clockwise rotation of linkage assembly 20 about pin 22, thus causing actuating rod 24 to translate axially rearward, i.e., toward rear surface 30 of housing 12. A return spring 32 provides a counterclockwise biasing force to trigger 16 which causes the trigger to return to its initial at-rest position upon release of the trigger by the operator.

It will be recognized that tool 10 will be used by different persons having various-sized grips. With respect to tool 10, the size of the grip is defined by rear surface 34 of fix grip 14 and forward surface 36 of trigger 16. The tool of the present invention allows the size of the tool grip to be adjusted to provide increased comfort and functionality of the tool while in the hands of a particular user. More particularly, the grip can be decreased for a person with smaller hands, or increased for a person with larger hands. It is believed that grip size adjustability provides increased comfort, less strain and better functionality of the tool during long term use. In this regard, connecting shaft 26 is provided with a threaded adjusting end 38 which cooperates with a grip adjustment knob 40. A clip 42 prevents complete unthreading of end 38 from knob 40. As best shown in FIG. 2*a,* trigger 16 includes a bow-tie shaped cutout 43 shaped to facilitate pivoting of the trigger about pin 18. In one preferred embodiment (with the nose of the tool pointed toward the operator), clockwise rotation of knob 40 decreases the grip of the tool, while counterclockwise rotation of knob 40 increases the grip of the tool.

Figure 2C:
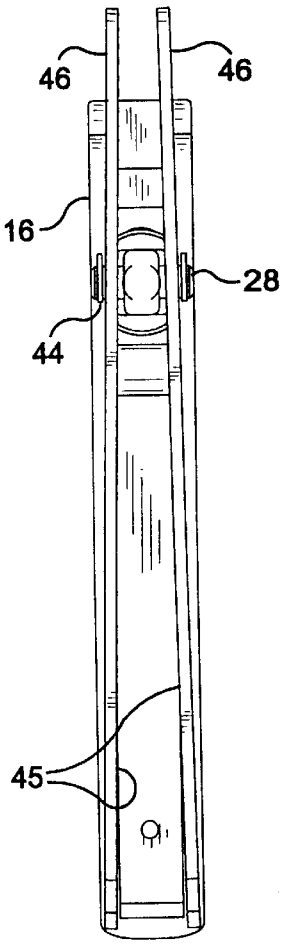
FIG. 2*c* is a side view of the trigger/linkage assembly of FIG. 2*b;*
Figure 2B:
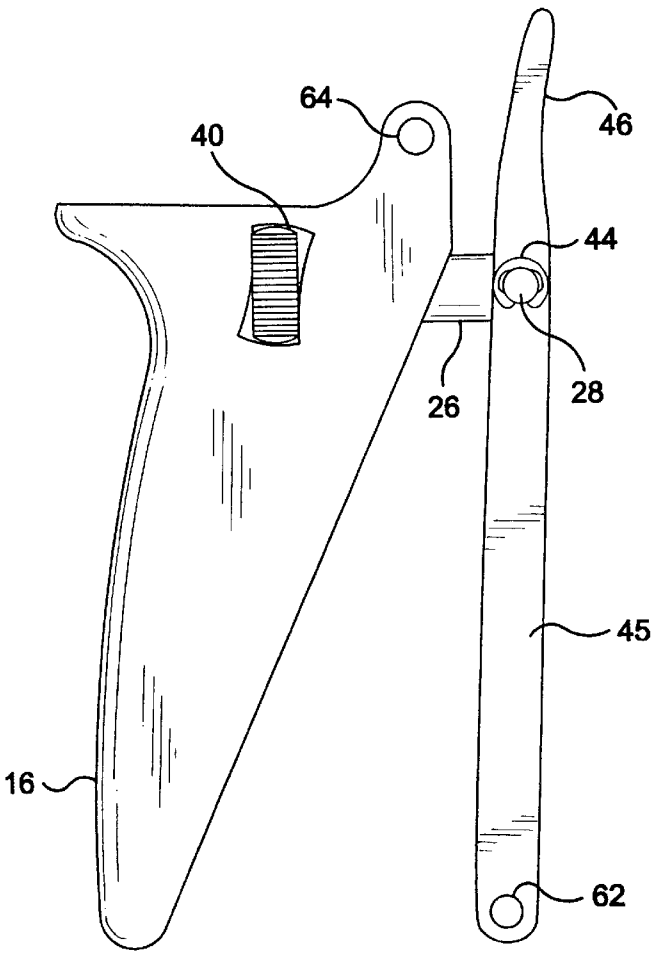
FIG. 2*b* is a detail of the trigger and linkage assembly of the tool of the present invention.
Figure 2A:
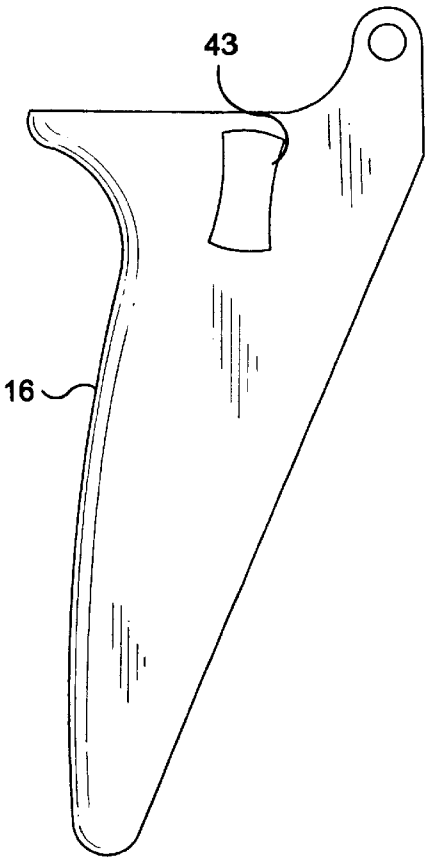
FIG. 2*a* is a detail of the trigger of the tool of the present invention.

Referring to FIGS. 2*b* to 2*c,* connecting shaft 26 is preferably coupled to linkage assembly 20 via connecting pin 28, which is coupled to linkage assembly 20 via locking clips 44. As best shown in FIG. 2*c,* linkage assembly 20 includes a pair of opposing symmetrically-shaped linkages 45. Each of linkages 45 has an operating end 46 shaped to cooperate with an end of actuating rod 24.

Figure 3:
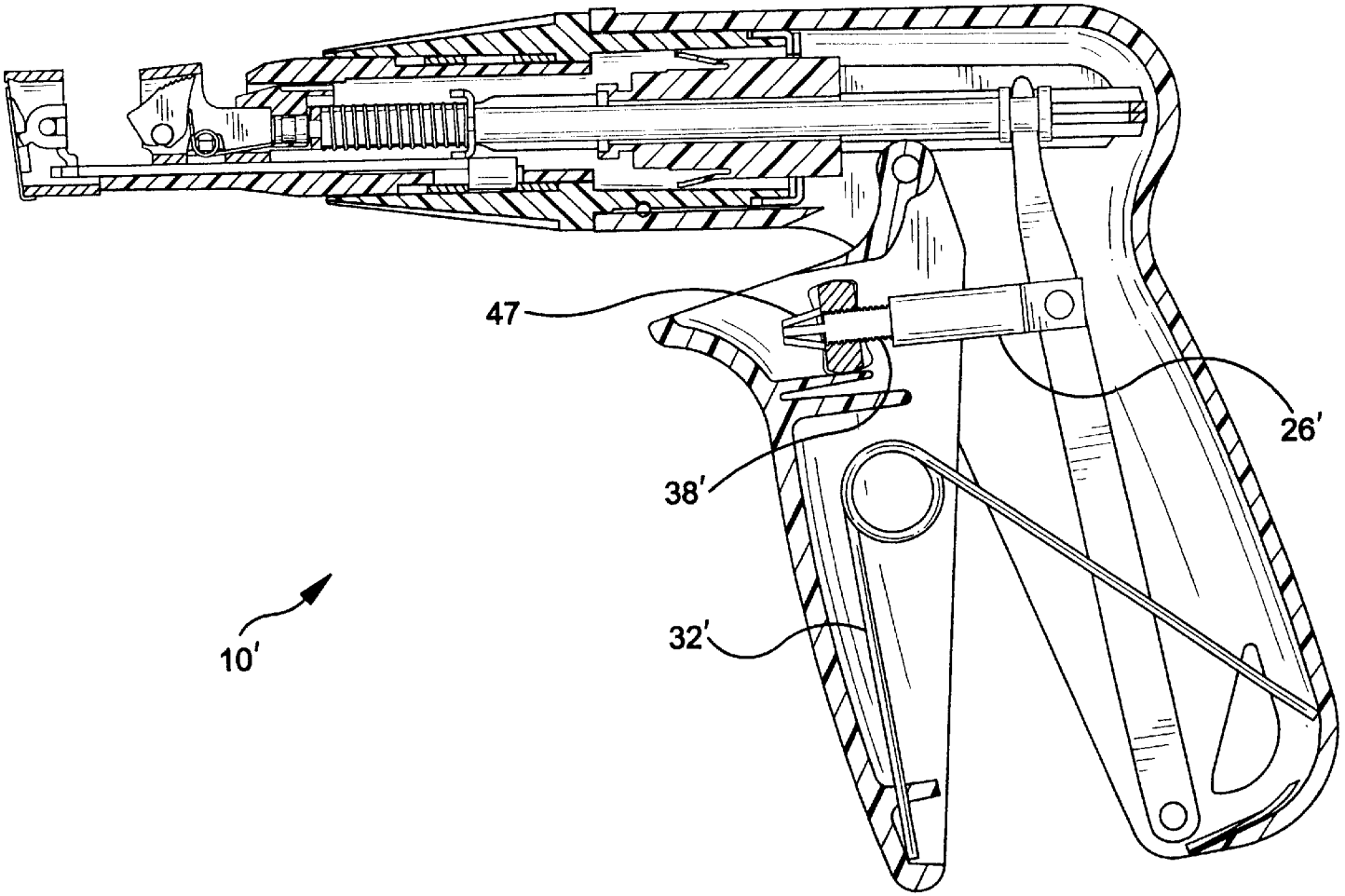
FIG. 3 is an elevational view in section of an alternative tool.
Figure 3A:
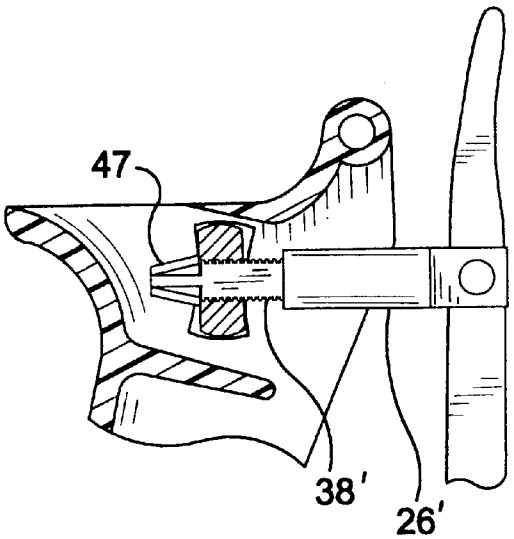
FIG. 3*a* is a detail of the grip adjusting mechanism of the tool of FIG. 3.

An alternative embodiment of the tool is shown in FIG. 3. Tool 10' includes an alternative return spring 32'. Of course, it is contemplated herein that other spring arrangements may be used to bias the trigger to its open, non-squeezed position. Tool 10' also includes an alternative connecting shaft 26'. Connecting shaft 26' includes a retention nose 47 (best shown in FIG. 3*a*) at its threaded end 38'. The retention nose acts to prevent complete unthreading of the threaded end from the grip adjustment knob.

Figure 4:
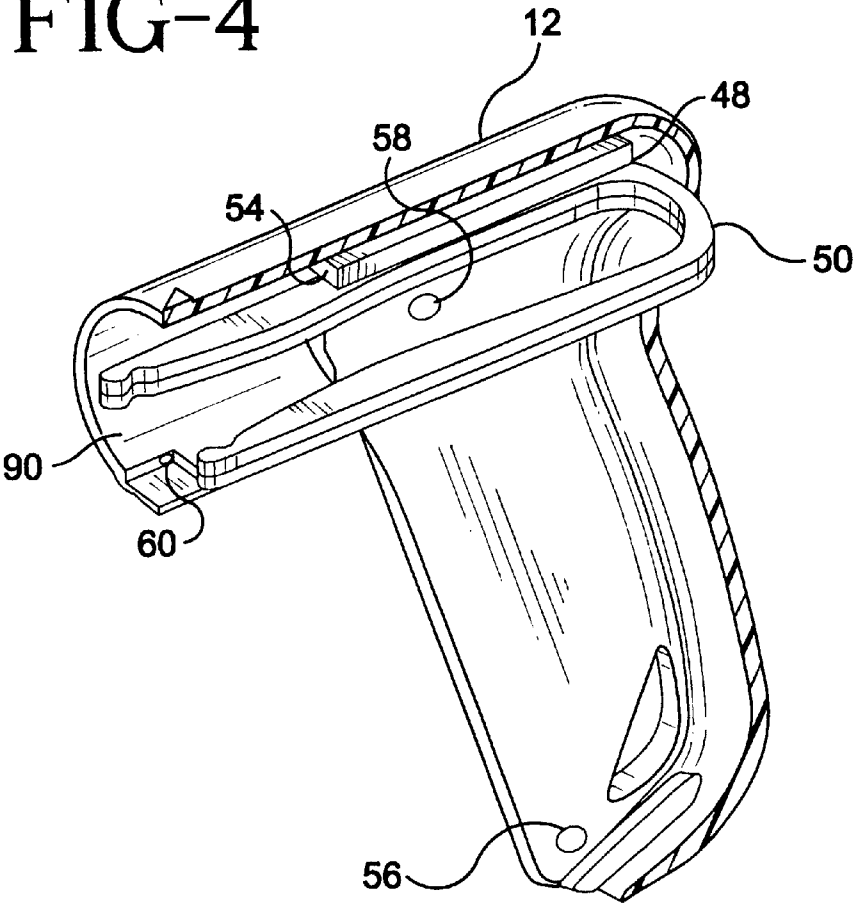
FIG. 4 is a perspective view of a portion of the tool housing showing the tension spring of the present invention mounted therein.
Figure 9:
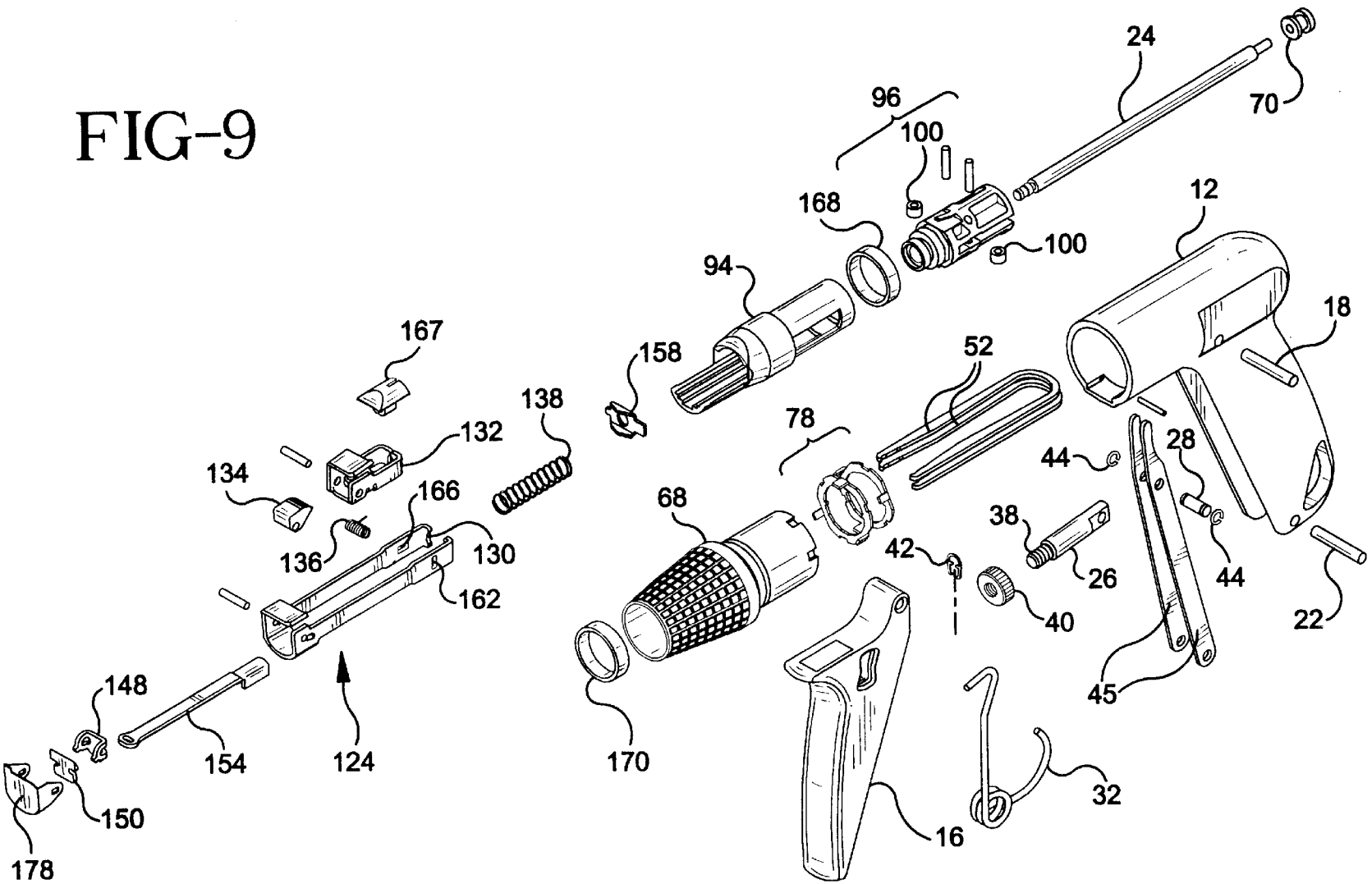
FIG. 9 is an exploded perspective view of the tool of the present invention.

Referring to FIG. 4, housing 12, which is preferably an integrally molded piece, includes a spring-receiving track 48 on each side of the housing. Track 48 is sized for receipt of a generally U-shaped tension spring 50. Tension spring 50 is sized to slide within housing 12 and remain supported therein by opposing tracks 48. The spring may be secured to the housing at the rear surface thereof by an adhesive or other suitable means. As best shown in FIG. 9, tension spring 50 is preferably formed from a pair of symmetrical spring elements 52.

Housing 12 further includes a shoulder 54 and apertures 56, 58 and 60, which cooperate with apertures on the opposing side of housing 12 (not shown in FIG. 4) to allow insertion of the above-mentioned pins therethrough. The apertures are formed with a diameter smaller than the diameter of the pins such that an interference fit is created when the pins are inserted into the apertures thereby retaining the pins therein. Pin 22, which passes through hole 62 (see FIG. 2*b*) formed in the lower portion of linkages 45, cooperates with aperture 56 to pivotally connect linkage assembly 20 to housing 12. Pin 18, which passes through hole 64 (see FIG. 2*b*) of trigger 16, cooperates with aperture 58 to pivotally connect trigger 16 to housing 12.

Figure 5:
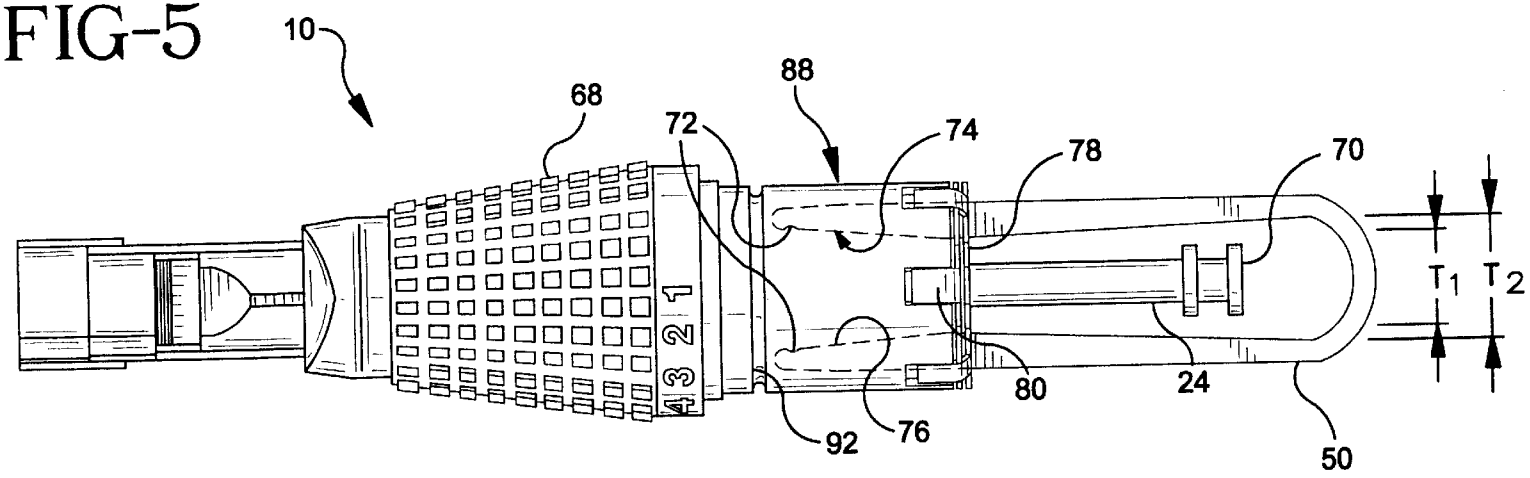
FIG. 5 is a top view of a portion of the tool with the housing removed for clarity.

Referring to FIG. 5, tool 10 includes a tension adjustment knob 68 rotatable with respect to housing 12 between a minimum tension setting, e.g. setting 1, and a maximum tension setting, e.g. setting 8. The tool is shown with the tension adjustment knob 68 at tension setting level 1. As shown, actuating rod 24 includes a dumbbell-shaped coupling 70 configured to cooperate with ends 46 of linkages 45. As best shown in FIG. 2*c,* linkages 45 converge towards one another in the upper portion of linkage assembly 20. This converging of the linking elements, together with the particular configuration of end 46 (as shown in FIG. 2*b*), allow the linkage assembly to readily couple with coupling 70 (as best shown in FIG. 1) and remain coupled thereto during squeezing of trigger 16. The configuration of ends 46 allows ends 46 to move with respect to coupling 70 during axial translation of actuating rod 24. As linkage assembly 20 rotates clockwise about pin 22 during squeezing of trigger 16, ends 46 slide through coupling 70 to extend beyond actuating rod 24, as shown in FIG. 3. The ends of linkages 45 are preferably spaced apart from one another at the location of pin 22 by a pair of ribs integrally formed in housing 12.

Figure 8:
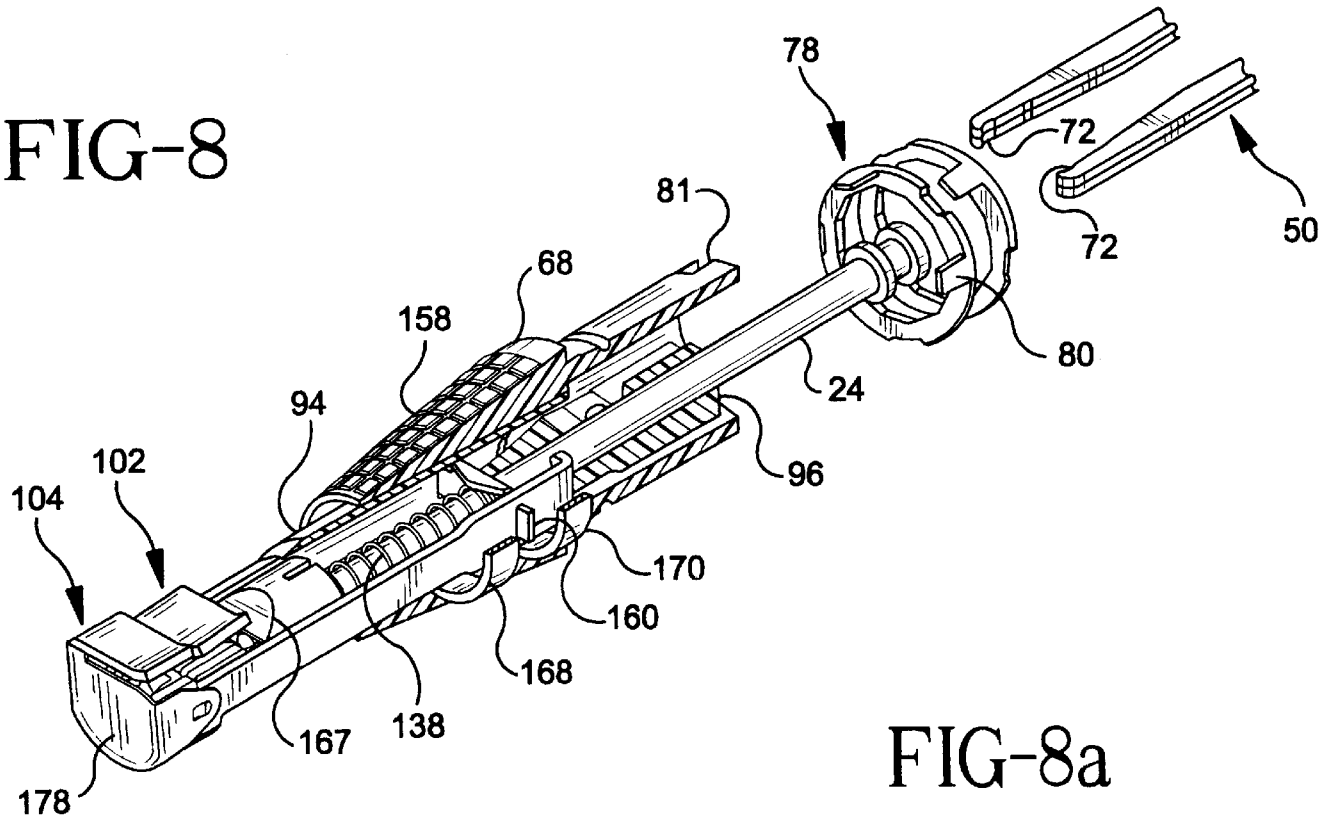
FIG. 8 is a perspective view with the tension adjustment ring and tension spring exploded away for clarity.

Tension spring 50 is formed with roller-receiving recesses 72 in a diverging forward region 74 of the spring. The distance between the interior surfaces 76 of tension spring 50 increase from $T_1$ to $T_2$ in the axial direction (i.e. along axis X). Tool 10 further includes a tension adjustment ring 78 which couples to the rear end of tension adjustment knob 68. As best shown in FIG. 8, ring 78 is preferably formed as two distinct elements which are thereafter sandwiched together. Ring 78 preferably includes a plurality of fingers 80 which are sized and/or shaped to cooperate with a plurality of grooves 81 (see FIG. 8) formed about the periphery of knob 68 to ensure that ring 78 can be installed in a single orientation only. Of course, it is contemplated that there are other means of attaching ring 78 to knob 68 in a predetermined orientation.

Figure 5A:
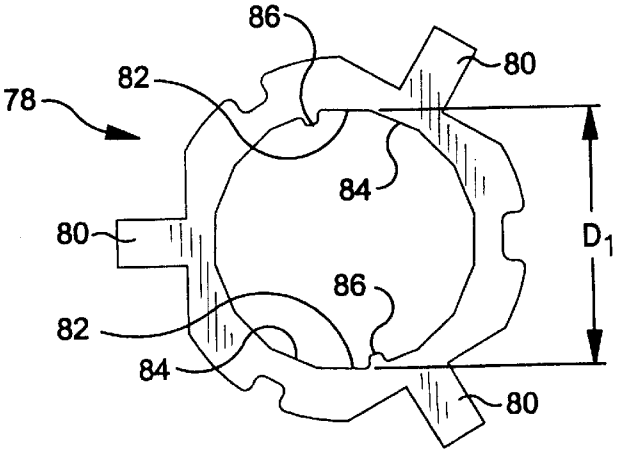
FIG. 5*a* is a manufacturing detail of the tension adjustment ring of the present invention.

Referring to FIG. 5*a,* ring 78 is formed with a plurality of opposing parallel surfaces. In one preferred embodiment, ring 78 includes eight opposing parallel contact surfaces which provides eight different tension adjustments for the tool. As shown, contact surfaces 82, which are parallel to one another, define a distance $D_1$ therebetween. Contact surfaces 82 contact tension spring 50 thus compressing tension spring 50 a predetermined amount. This predetermined amount of compression of tension spring 50 provides tension setting level 1, the tool of FIG. 5 being illustrated in tension setting level 1.

With the tool nose pointed towards the operator, counterclockwise rotation of tension adjustment knob 68 increases the tension setting level in the tool. More particularly, as the tension adjustment knob is rotated, tension spring 50 engages the next adjacent pair of parallel contact surfaces (see FIG. 5*a*). Each adjacent pair of parallel contact surfaces has a distance therebetween less than the distance of the preceding set of opposing parallel surfaces. Thus, as tension adjustment knob 68 is rotated from tension setting level 1 to tension setting level 2, ring 78 is simultaneously rotated such that surfaces 84 of ring 78 come into contact with tension spring 50. Inasmuch as the distance between surface 84 is less than distance $D_1$, tension spring 50 is placed under a greater compressive force than experienced in tension setting level 1.

As mentioned, ring 78 is provided with eight sets of opposing parallel contact surfaces which correspond to the eight tension setting levels of the tool, with tension setting level 8 providing the greatest amount of tension. Ring 84 is further provided with rotation stops 86 which prevent rotation of the tension adjustment knob beyond the minimum setting level 1 and maximum tension setting level 8. It will be appreciated by those skilled in the art that tension adjustment knob 68 is readily accessible to the user of the tool in that the adjusting knob may be readily grasped for rotation and that the tension setting levels are readily visible to the user during use of the tool. Unlike prior art tools which typically require plural turns of an adjusting screw to change the tension fitting, the knob/ring arrangement of the present invention allows rapid adjustment of the tension setting in the tool. It will be further recognized that the tension adjustment ring, which is located entirely within the housing of the tool, is protected from damage due to jarring or dropping of the tool and/or exposure to dirt and other environmental conditions commonly encountered in the manufacturing facility. The interaction of tension spring 50 with the other components of tool 10 will be discussed further hereinbelow.

When the tool is assembled, rear portion 88 (which defines a uniform diameter) of tension adjustment knob 68, slides within forward portion 90 of housing 12 until ring 78 contacts shoulder 54. Thereafter, a pin (not shown) is inserted through aperture 60. This pin engages a circumferentially-extending groove 92 formed in rear portion 88 of tension adjustment knob 68 thus preventing axial movements of the knob with respect to the housing while allowing rotational movement of such knob with respect thereto.

Figure 6A:
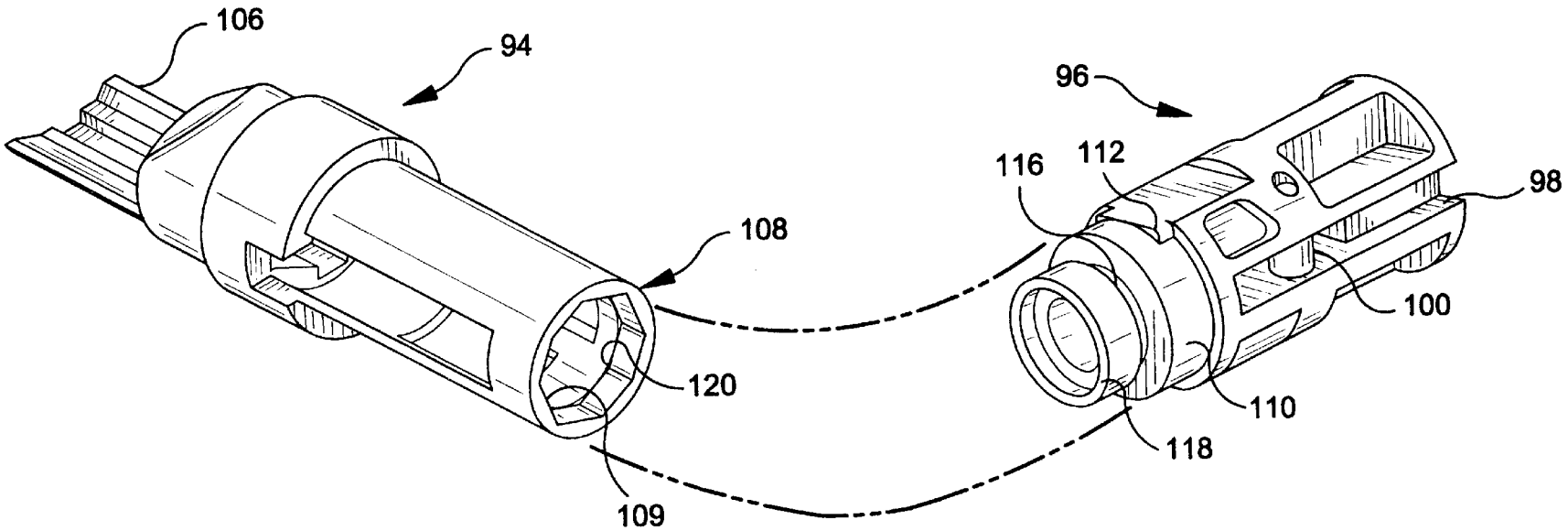
FIG. 6*a* is an exploded perspective view of the front tube and roller mount of the present invention.
Figure 6B:
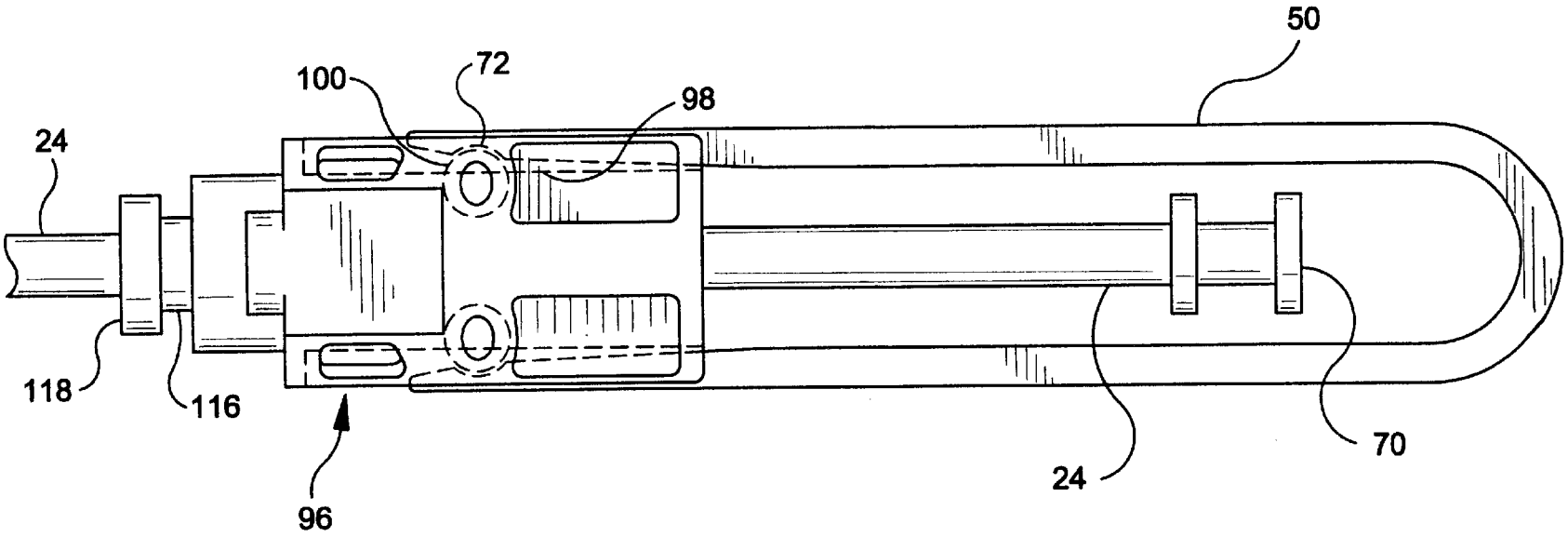
FIG. 6*b* is a top view of a portion of the tool showing the interaction between the roller mount and the tension spring.

Referring now to FIG. 6*a,* tool 10 includes a front tube 94 and a roller mount 96. Roller mount 96 includes a pair opposing axially-extending rectangular grooves 98 sized to receive the opposing legs of tension spring 50 therein. Roller mounts 96 further includes a pair of opposing rollers 100, one roller being mounted in each of grooves 98. Rollers 100 are rotationally unrestrained with respect to the roller mount. As best shown in FIG. 6*b,* recesses 72 of tension spring 50 cooperate with rollers 100 to couple the tension spring to the roller mount. It will be appreciated that because tension spring 50 is rotationally fixed with respect to housing 12 via track 48 and because tension spring 50 engages groove 98 of roller mount 96, the roller mount is also rotationally fixed with respect to housing 12. It will be further appreciated that recesses 72 of tension spring 50 prevent axial movement of roller mount 96 via their cooperation with rollers 100.

To accomplish axial movement of roller mount 96, a sufficient axial force must be applied to roller mount 96 to overcome the compressive tension force applied by tension spring 50 to roller mounts 100 whereby the rollers 100 move out of recesses 72 allowing the roller mount 96 to move axially with respect to tension spring 50 (tension spring 50 being fixed with respect to housing 12). This axial movements of roller mounts 96 is limited to axial movements in the rearward direction, i.e. movement of roller mount 96 towards the rear of the tool. When the axial force applied to roller mount 96 is removed, the diverging forward region 74 of tension spring 50 tends to urge the rollers (and roller mount) back to the at-rest condition (wherein rollers 100 are engaged within recesses 72). The force required to axially move roller mount 96 out of engagement with recesses 72 of tension spring 50 increases from a minimum force at tension setting level 1 to a maximum force of tension setting level 8. Once the rollers are moved out of engagement with recesses 72, continued axial movement of the roller mount toward the rear of the tool requires minimum force due to the geometry of diverging toward region 74.

Front tube 94 which supports tensioning mechanism 102 and cutting mechanism 104 (see FIGS. 7*a* and 7*b*) includes a support arm 106 and an engagement end 108. Engagement end 108 is formed with a circumferentially-extending collar 109 having eight equally spaced surfaces about the inner periphery thereof. The front tube allows rotation of the nose assembly of the tool with respect to the housing. This rotation of the nose assembly allows the installer to maintain the tool in a comfortable orientation while tensioning cable ties which are rotated with respect to the installer. In the present preferred embodiment of tool 10, the nose assembly is rotatable through 360° of rotation at 45° intervals. Once rotated, the nose assembly remains locked in the desired orientation. Of course, the number of available lockable positions may be varied from less than eight to greater than eight. Alternatively, the nose assembly of the tool could be limited to less than 360° of rotation, e.g., the new tool could be provided with only 180° of rotation.

Roller mounts 96 includes an engagement neck 110 sized to cooperate with engagement end 108 of front tube 94 and allow rotation of the front tube between a plurality of predefined angular orientations. In one preferred embodiment, engagement neck 10 includes opposing sets of rotation control surfaces 112. Control surfaces 112 interfere with a set of opposing parallel surfaces on engagement end 108 when the front tube and roller mount are coupled together, thus locking the front tube in a particular rotational orientation. When the nose assembly is rotated by the user, control surfaces 112 come into contact with the adjacent set of opposing parallel surfaces on engagement end 108. The material of the front tube, together with the configuration of end 108 and control surfaces 112, allow rotational movement of the nose assembly between the eight predefined angular orientations. The twisting force applied to the nose assembly overcomes the frictional interference between control surfaces 112 and the parallel surfaces of engagement end 108. Of course, it is contemplated herein that other means of coupling roller mount 96 to front tube 94 could be utilized. For example, engagement end 108 could be coupled to the roller mount in a conventional manner and the roller mount provided with an internal bearing assembly to allow predefined rotation of shoulder 110 with respect to the body of the roller mount.

Figure 6C:
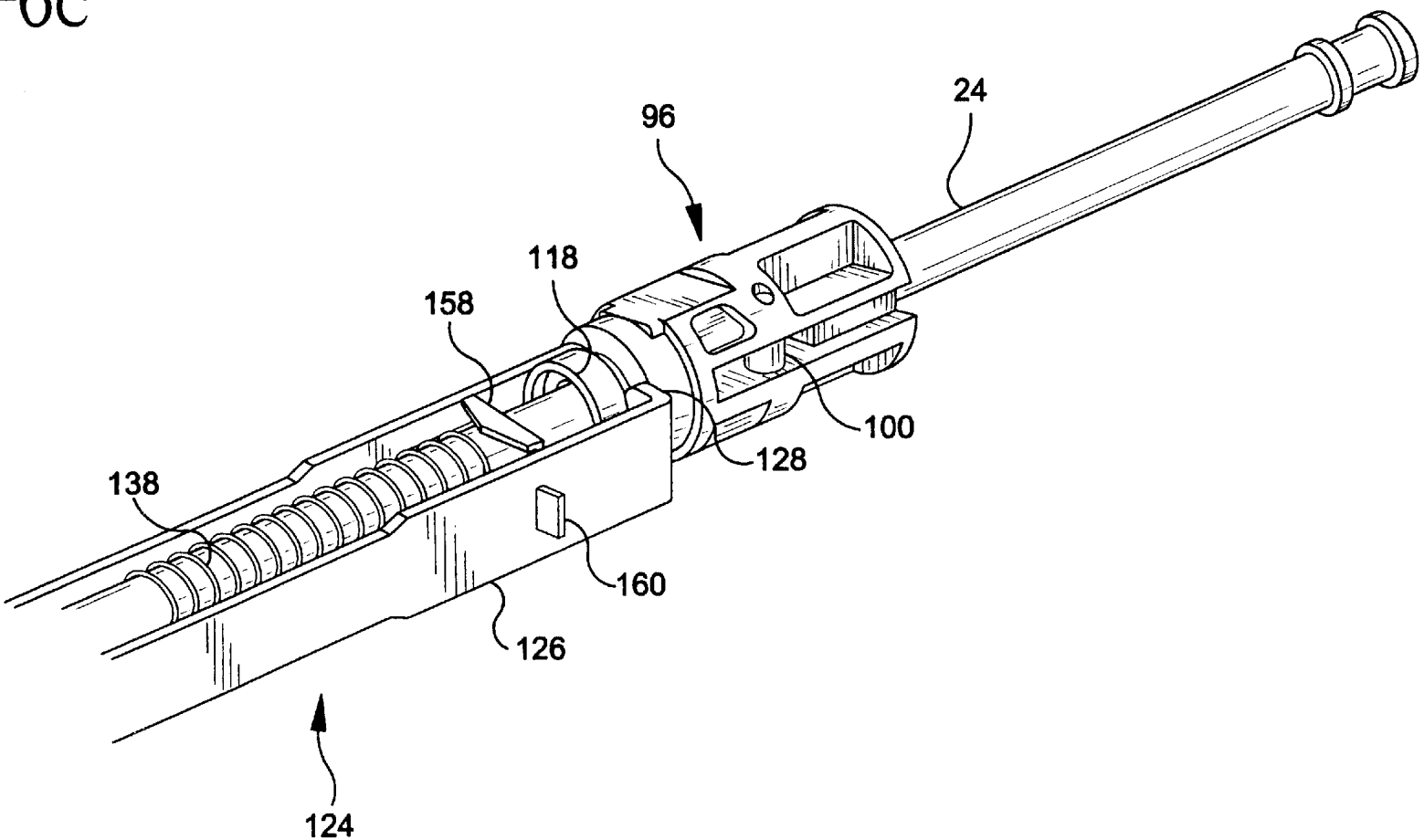
FIG. 6*c* is a perspective view of a portion of the tool showing the interaction between the fork assembly and the roller mount.

Roller mount 96 additionally includes a circumferentially-extending channel 116. The forward end 118 of roller mount 96 is sized to pass through aperture 120 formed in engagement end 108 of front tube 94. In this position, control surfaces 112 are engaged with one set of the opposing parallel surfaces of engagement end 108. Referring to FIG. 6*c*, roller mount 96 remains engaged with front tube 94 via a fork assembly 124. More particularly, legs 126 of fork assembly 124 are formed with inwardly-turned ends 128, each having a concavely-shaped cutout 130 (see FIG. 9). Cutouts 130 engage channel 116 on opposing sides thereof, thus preventing roller mount 96 from axial movement with respect to front tube 94, but allowing rotational movement thereto.

Figure 7:
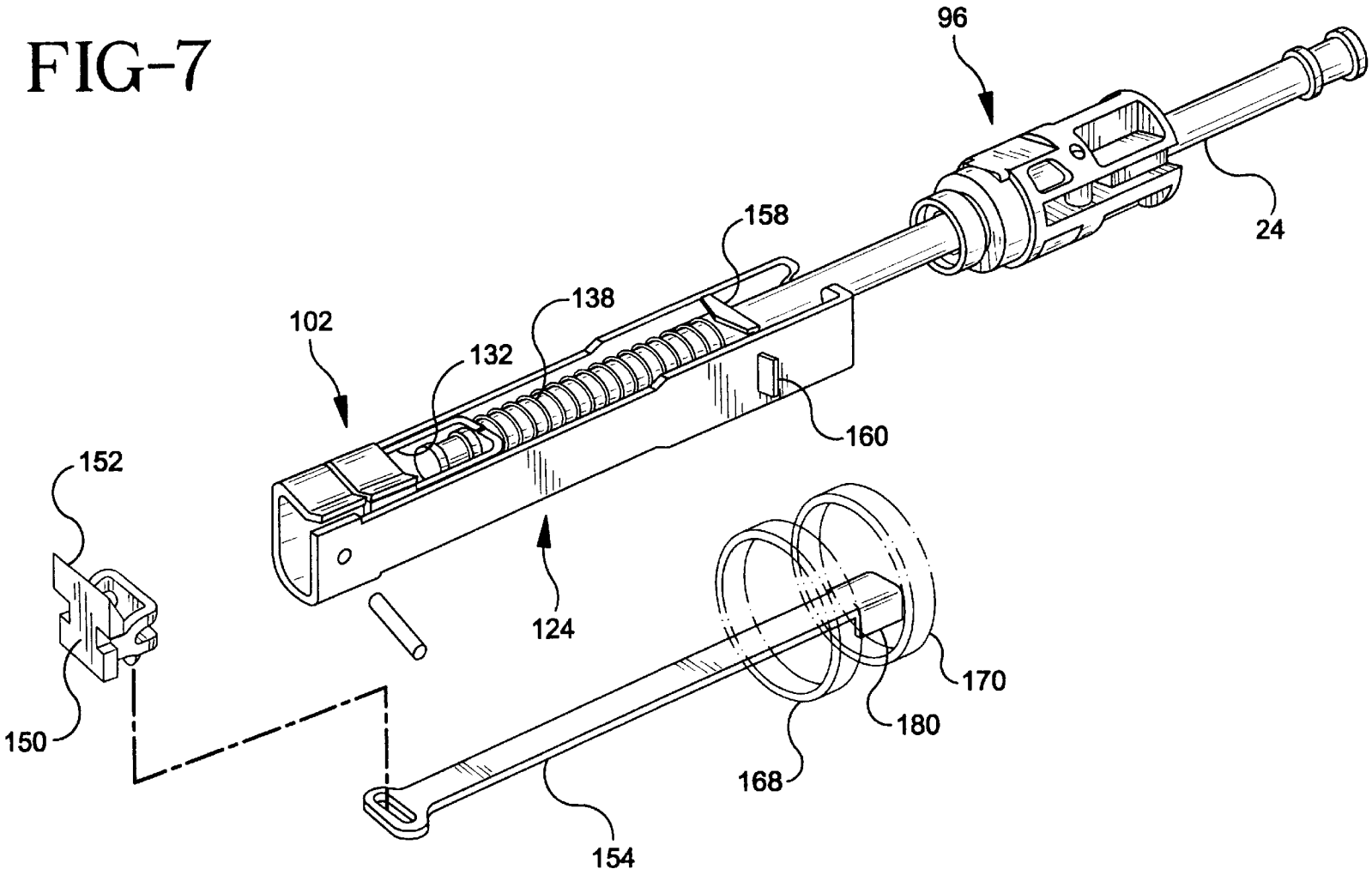
FIG. 7 is a perspective view of the fork assembly with the blade, linkage and arm exploded away for clarity.
Figure 7A:
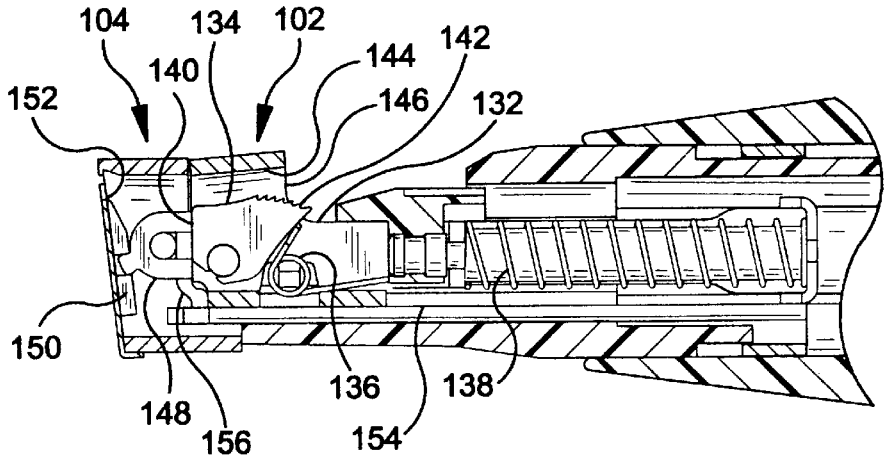
FIG. 7*a* is an enlarged detail of the nose portion of the tool showing the pawl rotated clockwise to allow insertion of a cable tie through a passage defined within the pawl cage.
Figure 7B:
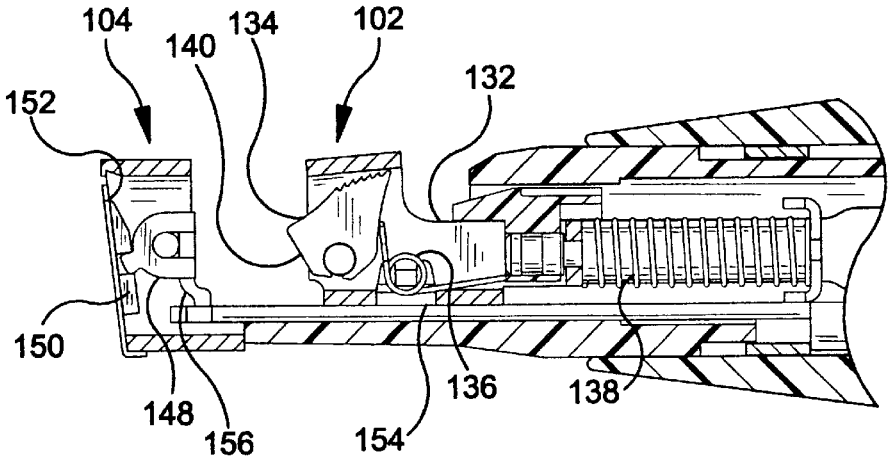
FIG. 7*b* is an enlarged detail of the nose portion of the tool showing the pawl cage moved axially rearward and the pawl rotated counterclockwise for gripping of a cable tie (not shown) within the pawl cage.

Referring to FIGS. 7, 7*a* and 7*b*, tensioning mechanism 102 includes pawl cage 132, pawl 134, pawl spring 136 and coil spring 138. Pawl 134 is biased in a counterclockwise direction (as viewed in FIG. 7*a*) by pawl spring 136. When the tool is in an at-rest position (as shown in FIG. 7*a*), tensioning mechanism 102 rests against cutting mechanism 104. More particularly, surface 140 of pawl 134 contacts cutting mechanism 104 thus causing pawl 134 to rotate clockwise. This clockwise rotation moves teeth 142 of pawl 134 away from tie engagement surface 144 thus providing a tail receiving pathway 146 for insertion of a cable tie therethrough. As tensioning mechanism 102 is moved rearward away from cutting mechanism 104, pawl spring 136 causes pawl 134 to rotate counterclockwise thus bringing teeth 142 into contact with surface 144. In operation, a tail end of a cable tie would be retained between teeth 142 and surface 144.

Cutting mechanism 104 includes linkage 148 which is pivotally mounted to fork assembly 124. Linkage 148 includes a blade 150 having a cutting edge 152. As will be described in further detail hereinbelow, axial movement of fork 124 with respect to arm 154 causes pivotal movement of linkage 148 which, in turn, drives blade 150 upward into cutting contact with the tail end of a cable tie. Finally, linkage 148 includes an engagement finger 156 which couples such linkage to arm 154.

Figure 8A:
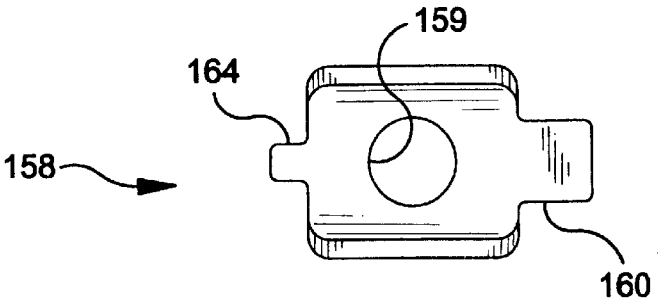
FIG. 8*a* is a detail of the lock washer of the present invention.

Referring now to FIG. 8, tool 10 further includes a lock washer 158 having an aperture 159 (see FIG. 8*a*) sized to allow passage of actuating rod 24 therethrough. Coil spring 138 rests against lock washer 158 at one of its ends. As shown, lock washer 158 includes a control key 160 which passes through a similarly shaped aperture 162 formed in one leg of fork assembly 124 (see FIG. 9). In one preferred embodiment, aperture 162 is rectangular in shape. The opposing side of lock washer 158 includes a tab 164 sized to slide within slot 166 formed in the other leg of fork assembly 124 (see FIG. 9). It will be recognized that the spring force applied to lock washer 158 tends to urge lock washer 158 to pivot about key 160, thereby frictionally binding the lock washer to actuating rod 24. When lock washer 158 is pivoted and frictionally engaged with actuating rod 24, axial movement of actuating rod 24 will produce axial movement of roll mount 96 and front tube 94. Tool 10 additionally includes a cap 167 for covering a portion of the pawl cage.

Tool 10 further includes a pair of rings 168, 170. Rings 168, 170 are sized to frictionally engage the inner periphery of tension adjustment knob 68. Ring 168 is positioned within adjustment knob 68 such that key 160 is pressed against such ring which maintains lock washer 158 in a perpendicular orientation with respect to fork assembly 124 and actuating rod 24. When lock washer 158 is maintained perpendicular to fork assembly 124, actuating rod 24 may freely travel through the aperture of the lock washer. More particularly, squeezing of trigger 16 causes actuating rod 24 to move axially rearward thus causing tensioning mechanism 102 to also move rearward. Upon releasing of trigger 16, spring 138 urges tensioning mechanism 102 forward to return to its initial at rest position, i.e., the position illustrated in FIG. 7*a*.

Figure 10:
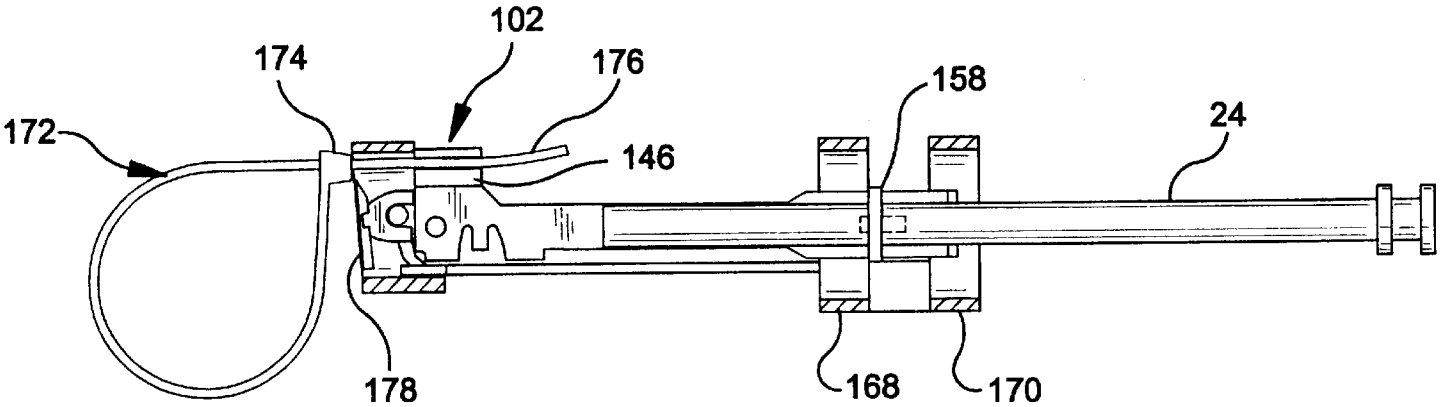
FIGS. 10–12*a* schematically illustrate the operation of the tool of the present invention.
Figure 10A:
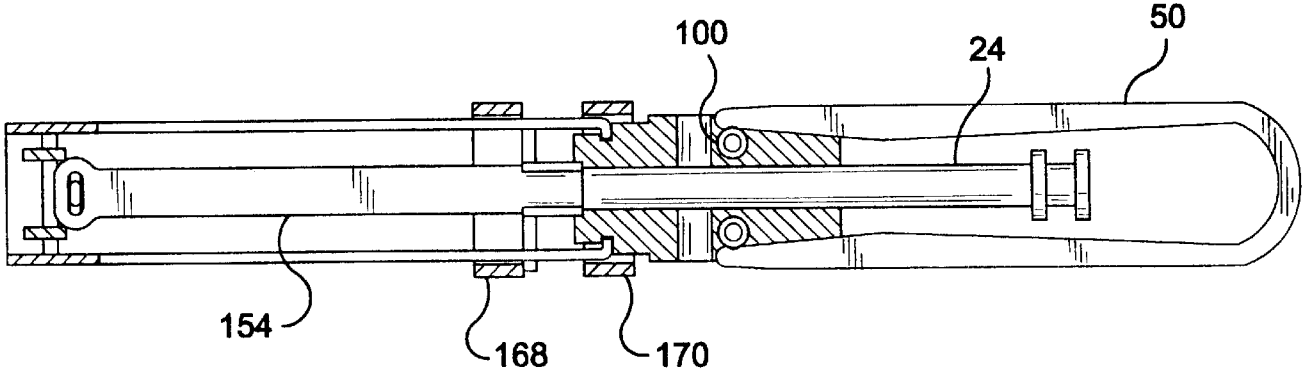
Figure 11:
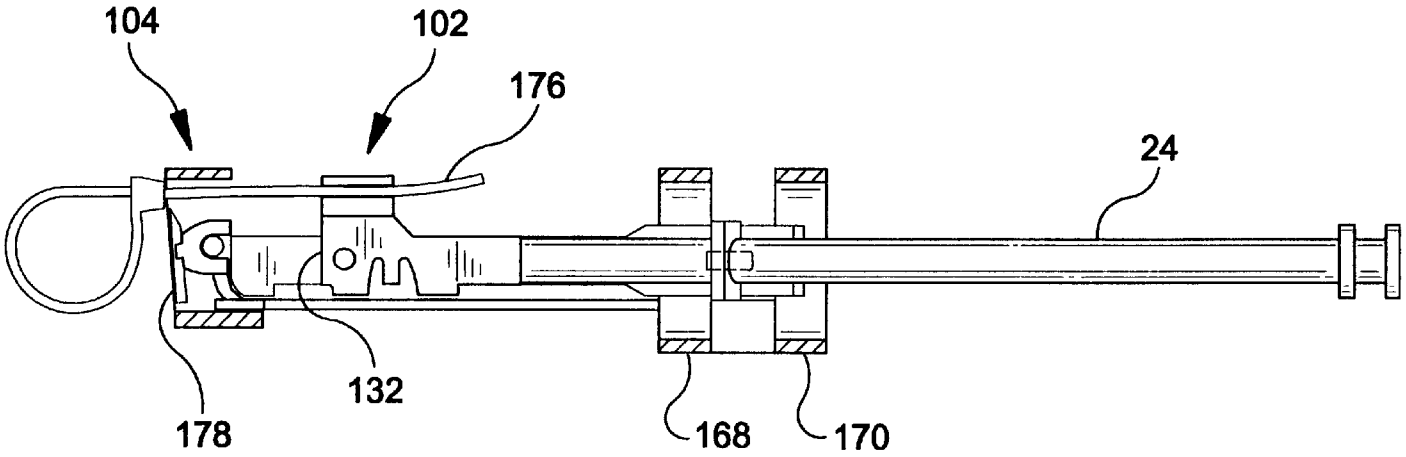
Figure 11A:
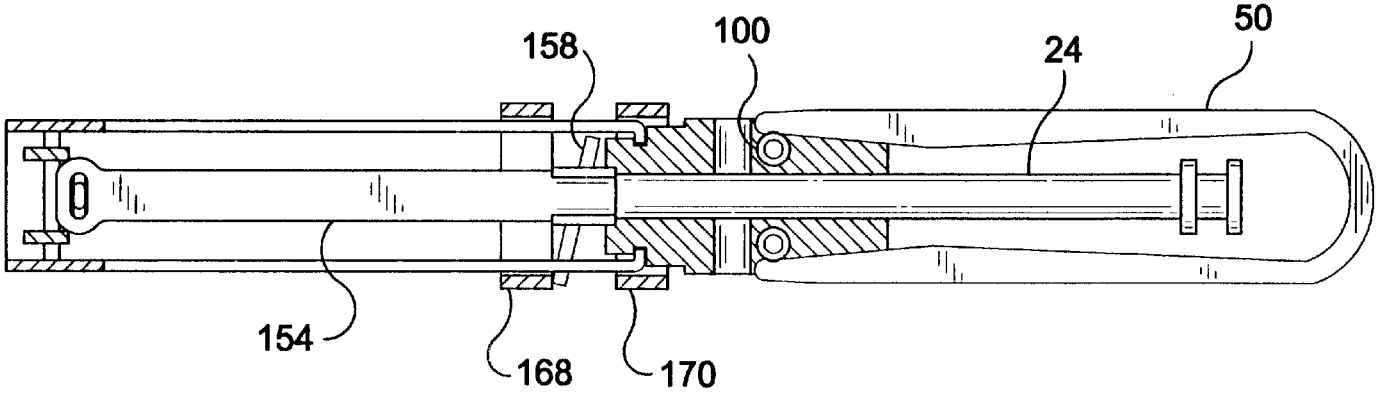
Figure 12:
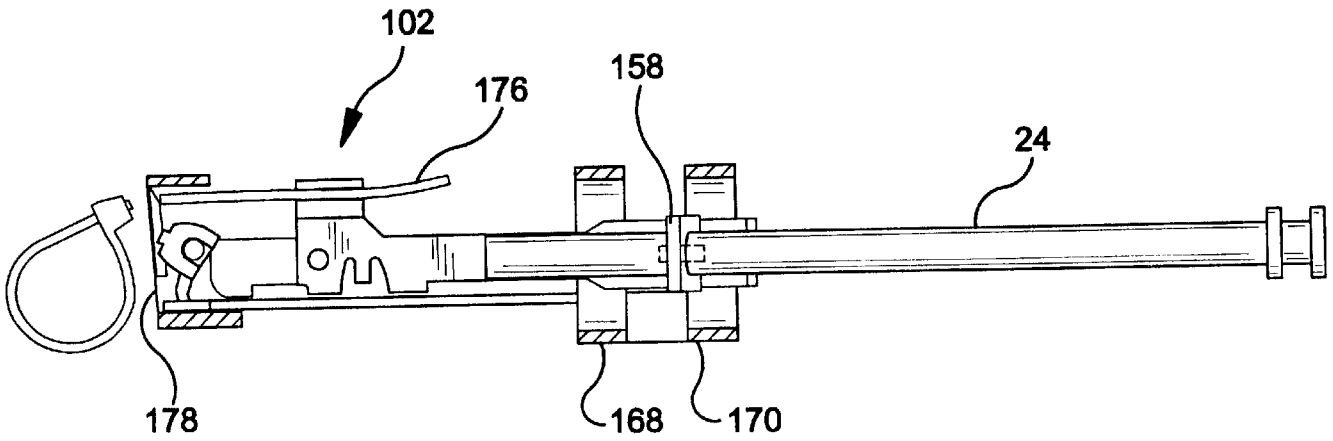
Figure 12A:
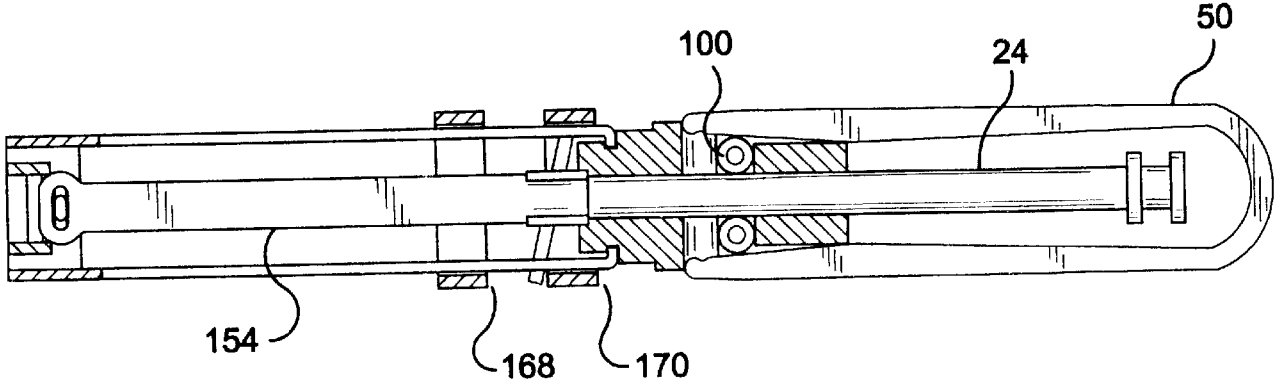

For ease of understanding, the components of tool 10 are shown in exploded format in FIG. 9. Referring now to FIGS. 10 to 12*c*, the operation of tool 10 will be explained. A cable tie 172 having a head 174 and a tail 176 is first manually secured about a bundle of articles. Thereafter, tail 176 is inserted through pathway 146 of tensioning mechanism 102. As shown in FIGS. 10 and 10*a*, ring 168 presses against lock washer 158 whereby lock washer 158 is maintained in a perpendicular orientation with respect to actuating rod 24. Upon squeezing of trigger 16 by the user of the tool, actuating rod 24 is moved axially rearward, thus causing tensioning mechanism 102 to simultaneously move rearward.

Once pawl cage 132 is moved away from cutting mechanism 104, pawl 134 rotates counterclockwise thus gripping tail end 176 of the cable tie between teeth 142 of the pawl and tie engagement surface 144 of the pawl cage. Rearward axial movement of tensioning mechanism 102 (to the right in FIG. 11) causes tightening of the cable tie about the bundle of articles. In this regard, it will be appreciated by those skilled in the art that tensioning mechanism 102 moves axially with respect to nose surface 178 of cutting mechanism 104 thus producing tightening of the cable tie.

Tensioning mechanism 102 can move only a limited axial distance before pawl cage 132 causes maximum compression of coil spring 138. This maximum axial movement is caused by complete squeezing of trigger 16. Upon release of trigger 16, coil spring 138 urges pawl cage 132 axially forward (to the left in FIG. 11). If the tie has not been sufficiently tightened, the trigger may again be squeezed to further tighten the cable tie. This process may be repeated as many times as necessary to tighten the cable tie to the predetermined tension level.

Once the predetermined level of tension has been reached in the cable tie, roller mounts 100 begin to move out of recesses 72. This initial movement of roller mount 96 also causes fork assembly 124 to move slightly rearward. Inasmuch as ring 168 is axially fixed within tension adjustment knob 68, which in turn is axially affixed with respect to housing 12 and tension spring 50, lock washer 158 pivots about key 160 thus frictionally locking fork assembly 124 to actuating rod 24. Thus, additional squeezing of trigger 16 causes further axial movement of actuating rod 24, which in turn produces rearward axial movement of fork assembly 124.

As fork assembly 124 moves rearward, arm 154 is restrained from axial movement by the interaction of leg 180 and ring 170. Thus, further rearward axial movement of fork assembly 124 causes pivoting of linkage 148, which in turn raises blade 150 into cutting contact with cable tie 172. The tail of the cable tie is thereby severed at a location adjacent to the head of such tie. Upon release of the trigger, the spring force imparted on rollers 100 by surfaces 76 of tensioning 50 causes the roller mount 96 to move axially forward until rollers 100 are again captured within recesses 72 of tension spring 50.

The tool of the present invention is provided with a non-recoil design which reduces the shock and vibration which would otherwise be transferred to the hand of the operator. It will be appreciated that recoil shock produces operator fatigue in that a typical operator may install hundreds of ties a day. The recoil/shock vibration experienced in prior art tools results from the fact that the tensioning mechanism continues to tighten the band during the severing operation and/or the tensioning mechanism tends to "spring-back" toward the rear of the tool upon severing of the cable tie tail from the tightened cable tie band.

In the tool of the present invention, the band is tightened to a predetermined tension, with the cable tie tail thereafter being severed without any additional tightening of the cable tie. As explained hereinabove, upon reaching the predetermined level of tension, the tensioning mechanism 102, together with cutting mechanism 104 travel together axially toward the rear of the tool upon continued squeezing of trigger 16. Inasmuch as tie engagement surface 144 remains at a fixed axial distance with respect to nose surface 178, the additional squeezing of trigger 16 to operate the cutting mechanism (and thus sever the tail end of the cable tie) does not produce any additional tightening of the cable tie. As discussed, this additional tightening of the cable tie during the cutting operation of prior art tools introduces recoil shock and vibration into the tool upon severing of the cable tie tail from the installed cable tie.

The tool of the present invention also reduces and/or eliminates recoil shock and vibration by eliminating the tendency of the tensioning mechanism to spring backwards towards the rear of the tool upon severing of the cable tie tail. As discussed, upon reaching the predetermined tension level setting, roller mount 96 begins to move axially towards the rear of the tool thus causing rollers 100 to begin to move out of recesses 72 in tension spring 50. The initial axial movement of roller mount 96 is sufficient to axially move key 160 of lock washer 158 away from ring 168, thus allowing lock washer 158 to pivot about key 160. This pivoting of lock washer 158 results from the spring force imposed thereon by coil spring 138, the pivoting of lock washer 158 frictionally locking actuating rod 24 to fork assembly 124. Once the actuating rod is locked to fork assembly 124, continued squeezing of trigger 16 (which continues to move actuating rod 24 axially rearward) causes fork assembly 124 to also move towards the rear of the tool. Leg 180 of arm 154 thereafter contacts ring 170 thus causing pivoting of linkage 148, which drives blade 150 upward to sever the cable tie tail.

It will therefore be appreciated that the cable tie tail is severed while the tensioning mechanism and the cutting mechanism are axially fixed to one another by means of lock washer 158. Thus, upon cutting of the cable tie tail from installed cable tie, tensioning mechanism 102 is unable to spring backwards towards the rear of the tool due to the tension being imparted to the cable tie. This inability of the tensioning mechanism to spring backwards towards the rear of the tool reduces and/or eliminates recoil shock and vibration in the tool. Upon release of the trigger, interior surfaces 76 of tension spring 50 urge roller mount 96 axially toward the front of the tool until rollers 100 are again recaptured within recesses 72 of tension spring 50. This urging of roller mount 96 axially forward also urges key 160 of lock washer 158 into abutting contact with ring 168 thus pivoting lock washer 158 out of frictional engagement with actuating rod 24. Once lock washer 158 is pivoted out of frictional engagement with actuating rod 24, actuating rod 24 can again be operated by trigger 16 to move tensioning mechanism 102 without any axial movement of cutting mechanism 104.

Other methods of axially fixing actuating rod 24 to fork assembly 124 upon reaching a predetermined tension setting level are also contemplated herein. For example, the tool of the present invention may include an actuating rod wherein the forward portion of the rod is formed with a plurality of teeth which cooperate with a pair of spring-biased shoulders. The shoulders are spring biased towards a position in which their teeth remain out of engagement with the teeth on actuating rod 24. Upon reaching the predetermined level of tension and producing initial axial movement of roller mount 96, the shoulders move into engagement with at least one of the rings, which cause the shoulders to pivot such that the teeth of the shoulder engage the teeth of the actuating rod thereby axially fixing the actuating rod to the fork assembly. Of course, other methods of axially fixing actuating rod 24 to fork assembly 124 upon reaching the predetermined level of tension are also contemplated herein.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included within the scope of the following claims.

What is claimed is:

1. A tool for installation of a cable tie, said cable tie including a head and an elongate tail extending therefrom, said tool comprising:

a generally pistol-shaped housing, said housing operatively supporting a tensioning mechanism for tensioning said cable tie to a predetermined tension setting and a cutting mechanism for severing an excess portion of said tail from said tensioned cable tie;

said housing including a fixed grip and a movably mounted trigger cooperating with said grip whereby movement of said trigger with respect to said grip operates said tensioning and cutting mechanisms; and wherein said grip and trigger are spaced a distance from one another thus defining a grip size which is encountered by a hand of an installer, and wherein said trigger is adjustable with respect to said grip to vary said distance therebetween thus varying said grip size to facilitate use of said tool by various installers.

2. The tool according to claim 1, wherein said trigger is pivotally mounted to said housing.

3. The tool according to claim 2, wherein said grip includes a spring-biased linkage assembly, one end of said linkage assembly being pivotally mounted to said grip and the other end of said linkage assembly cooperating with said tensioning and cutting mechanisms; and further comprising an adjustable connecting shaft extending between said trigger and said linkage assembly whereby angular translation of said trigger towards said grip causes operation of said tensioning and cutting mechanisms.

4. The tool according to claim 3, wherein said trigger includes a rotationally-unrestrained axially fixed adjustment knob, and wherein one end of said connecting shaft is pivotally connected to said linkage assembly and the other end of said connecting shaft is threaded to cooperate with said adjustment knob whereby rotation of said knob causes angular translation of said trigger about said housing to vary said grip size.

5. The tool according to claim 4, wherein said trigger includes a generally bow-tie shaped cut-out, and wherein said threaded end of said connecting shaft engages said knob within said cut-out whereby said knob is non-slidably retained therein; and further comprising rotational stop means cooperating with said threaded end of said connecting shaft for limiting rotation of said adjustment knob beyond a predefined point.

6. The tool according to claim 5, wherein said rotational stop means comprises a clip sized to engage a portion of said other end of said connecting shaft.

7. The tool according to claim 5, wherein said linkage assembly includes a pair of opposing linkages, and a connecting pin extending therebetween, wherein said one end of said connecting shaft includes a circular aperture sized to allow passage of said connecting pin therethrough whereby said connecting shaft is pivotally connected to said linkage assembly.

8. The tool according to claim 7, further comprising an axially-recipricating actuating rod, one end of said rod including a generally dumbbell-shaped coupling, and wherein each of said linkages includes an operating end shaped to cooperate with said coupling, the other ends of said linkages being pivotally connected to said grip, and wherein said operating ends are spaced a distance $L_1$ from one another and wherein the other ends of said linkages are spaced a distance $L_2$ from one another, $L_1$ being less than $L_2$.

9. The tool according to claim 8, wherein said grip includes a pair of ribs for spacing the other ends of said linkages apart from one another.

10. The tool according to claim 8, wherein said trigger is pivotable between a first unsqueezed position wherein said trigger is at a maximum distance from said grip and a second squeezed positioned wherein said trigger is at a minimum angular distance with respect to said grip; and further comprising a spring for biasing said trigger to said first unsqueezed position.

11. The tool according to claim 10, wherein said spring is contained within said grip with at least a portion secured thereto, one end of said spring acting upon said grip and the other end of said spring acting upon said linkage assembly.

12. The tool according to claim 11, wherein said other ends of said linkages are rotatably connected to said grip via a pin, and wherein said pin cooperates with said spring to retain said spring within said grip.

13. A tool for installation of a cable tie, said cable tie including a head and an elongate tail extending therefrom, said tool comprising:

a housing;

a nose portion carried by said housing, said nose portion including a tensioning mechanism for tensioning said cable tie and further including a cutting mechanism for severing an excess portion of said tail from said tensioned cable tie;

a trigger mounted to said housing for operating said tensioning and cutting mechanisms; and wherein said nose portion is rotatable with respect to said housing to allow ready installation of rotated cable ties while maintaining said tool in an ergonomically comfortable orientation.

14. The tool according to claim 13, wherein said nose portion is provided with a plurality of rotational steps which allow incremental rotation of said nose portion through 360° of rotation.

15. The tool according to claim 14, wherein said nose portion includes a front tube having an engagement end with a plurality of internally-located rotational steps; and further comprising a roller mount rotationally fixed with respect to said housing, said roller mount including an engagement neck having rotation control surfaces thereon which allows stepwise rotation of said nose portion between said rotational steps upon application of a rotational nose adjusting force to said nose portion.

16. The tool according to claim 15, wherein said engagement end includes eight rotational steps.

17. The tool according to claim 15, wherein said engagement end of said front tube and said engagement neck of said roller mount are formed of glass-filled nylon.

18. The tool according to claim 15, further comprising a fork assembly supported by said front tube, said fork assembly including a pair of opposing inwardly-turned ends each having a concavely-shaped cutout, and wherein said roller mount includes a forward end having a circumferentially-extending channel located thereon, said forward end being sized to pass through said engagement end to allow said concavely-shaped cutouts of said ends to engage opposing portions of said circumferentially-extending channel whereby said fork assembly is axially fixed with respect to said roller while remaining rotationally unrestrained with respect thereto.

19. The tool according to claim 18, further comprising a pawl cage for gripping said tail of said cable tie for tensioning thereof, said pawl cage rotationally fixed with respect to said fork assembly, and further comprising an axially-recipricating actuating rod having a first end operatively connected to said trigger and a second end connected to said pawl cage in a rotationally unrestrained manner.

20. The tool according to claim 19, further comprising a blade carried by said fork assembly for severing said excess portion of said cable tie; and an arm for operating said blade, one end of said arm operatively connected to said blade to move said blade into cutting engagement with said cable tie upon relative axial movement between said arm and said fork assembly, the other end of said arm cooperating with an axially-fixed member carried by said housing which limits axial movement of said arm with respect to said housing while allowing rotational movement with respect thereto.

21. A tool for installation of a cable tie, said cable tie including a head and an elongate tail extending therefrom, said tool comprising:

a housing, said housing operatively supporting a tensioning mechanism for tensioning said cable tie to a predetermined tension setting and a cutting mechanism for severing an excess portion of said tail from said tensioned cable tie;

a trigger mounted to said housing for operating said tensioning and cutting mechanisms; and means for temporarily securing said tensioning and cutting mechanisms together during severing of said excess portion of said tail from said cable tie to prevent further tensioning of said cable tie and to eliminate recoil of said tensioning mechanism.

22. The tool according to claim 21, wherein said tensioning mechanism includes a pawl cage and a spring-loaded pawl carried by said cage, and wherein said cutting mechanism includes a fork assembly; and further comprising an axially-reciprocating actuating rod having a first end operatively connected to said trigger and a second end connected to said pawl cage whereby operation of said trigger causes axial directed movement of said pawl cage for tensioning of said cable tie; and wherein said securing means comprises a lock washer supported by said fork assembly and cooperating with said actuating rod to secure said actuating rod to said fork assembly upon tensioning of said cable tie to said predetermined tension setting whereupon further axial translation of said actuating rod produces simultaneous axial translation of said fork assembly and said pawl cage with respect to said housing.

23. The tool according to claim 22, wherein said pawl cage is movable between a first position wherein said pawl and pawl cage define a tail-receiving pathway and a second position wherein said pawl cooperates with an engagement surface of said cage to grip said tail therebetween, and wherein said pawl cage is movable from said first position to said second position upon squeezing of said trigger and is biased to return to said first position upon release of said trigger; and and wherein said lock washer includes an aperture sized to allow passage of said actuating rod therethrough and a control key and a tab located on opposing sides thereof;

and wherein said fork assembly includes an aperture sized to allow passage of said control key therethrough and further includes a slot sized to allow axially-directed movement of said tab therein whereby said lock washer may be pivoted from a first position wherein said washer is substantially perpendicular to said actuating rod to allow axially-directed movement of said rod therethrough and a second position wherein said washer is pivoted about said control key to frictionally engage said actuating rod thus temporarily securing said fork assembly to said actuating rod; and further comprising a coil spring extending between said pawl cage and said lock washer for biasing said lock washer to said second position.

24. The tool according to claim 23, wherein said housing includes a first axially-fixed member located to press against said key of said lock washer to urge said lock washer to said first position when said tool is in a non-cutting mode, and wherein said member and key are distanced from one another when said tool is in a cutting mode to allow said lock washer to pivot about said key and secure said fork assembly to said actuating rod.

25. The tool according to claim 24, further comprising:

a blade for severing said tail of said cable tie;

an arm operatively connected to said blade for moving said blade into cutting engagement with said tail;

a blade linkage pivotally supported by said fork assembly and cooperating with said blade to move said blade into cutting engagement with said tail upon relative axial translation between said arm and said housing; and wherein one end of said arm is connected to said linkage and the other end of said arm cooperates with a second axially-fixed member carried by said housing which limits axial movement of said arm with respect to said housing during severing of said excess tail portion.

26. The tool according to claim 25, wherein said axially-fixed members comprise annular rings frictionally retained within said housing.

27. The tool according to claim 25, further comprising a roller mount having an aperture to allow passage of said actuating rod therethrough and a tension spring to axially fix said roller mount within said housing until said predetermined tension setting is achieved in said cable tie whereupon axial translation of said roller mount causes said first member and key to move out of pressing contact with one another whereby said lock washer pivots thus securing said actuating rod to said fork assembly so that further squeezing of said trigger causes simultaneous axially-directed movement of said fork assembly and said pawl cage with respect to said housing.

28. A tool for installation of a cable tie, said cable tie including a head and an elongate tail extending therefrom, said tool comprising:

a housing, said housing operatively supporting a tensioning mechanism for tensioning said cable tie to a predetermined tension setting and a cutting mechanism for severing an excess portion of said tail from said tensioned cable tie;

a trigger mounted to said housing for operating said tensioning and cutting mechanisms;

a generally U-shaped tension spring for applying a predetermined amount of resistance to said tensioning mechanism to allow tensioning of said cable tie to a predetermined tension setting; and a tension adjustment ring carried by said housing and having a plurality of sets of opposing contact surfaces which cooperate with said tension spring, each of said sets corresponding to a predetermined tension setting whereby rotation of said ring adjusts the tension setting in said tool.

29. A tool according to claim 28, further comprising an axially-reciprocating actuating rod having a first end operatively connected to said trigger and a second end mechanically communicating with said tensioning and cutting mechanisms;

a roller mount having an aperture sized to allow passage of said actuating rod therethrough and further including a set of opposing rollers; and wherein said tension adjustment ring includes an aperture sized to allow passage of said tension spring therethrough and wherein said sets of opposing contact surfaces are located around the periphery of said ring aperture whereby said tension spring engages one of said sets of opposing contact surfaces; and wherein said tension spring includes a pair of opposing roller-receiving recesses for engagement with said rollers of said roller mount.

30. The tool according to claim 29, wherein said roller mount includes a pair of opposing grooves, each of said grooves including one of said rollers, said grooves engaging opposing sides of said U-shaped tension spring whereby said roller mount and said tension are rotationally fixed with respect to one another.

31. The tool according to claim 30, wherein said housing includes a spring-receiving track to rotationally secure said spring to said housing.

32. The tool according to claim 30, further comprising a tension adjustment knob carried by said housing, said tension adjusting knob axially fixed with respect to said housing while remaining rotationally unrestrained with respect thereto, said tension adjusting knob including a generally tubular rear portion which surrounds said roller mount, and wherein said tension adjustment ring is coupled to said rear portion of said tension adjusting knob whereby rotation of said tension adjustment knob by said installer causes simultaneous rotation of said tension adjustment ring.

33. The tool according to claim 32, wherein said tension adjustment knob includes external visual indicators corresponding to the tension setting in said tool.

34. The tool according to claim 32, wherein an end of said tubular rear portion of said tension adjustment knob includes a plurality of grooves about the periphery thereof, and wherein said tension adjustment ring includes a plurality of fingers sized and shaped to cooperate with said plurality of grooves whereby installation of said tension adjustment ring is limited to only one angular orientation.

35. The tool according to claim 34, wherein said tension adjustment ring includes at least one stop for limiting rotation beyond a minimum tension setting and beyond a maximum tension setting.

36. A tool for installation of a cable tie, said cable tie including a head and an elongate tail extending therefrom, said tool comprising:

a generally pistol-shaped housing having a barrel portion and a grip portion;

a nose portion cooperating with and supported by said barrel portion of said housing, said nose portion being axially translatable with respect to said barrel portion of said housing, said nose portion including a blade movable between a first stowed position and a second cutting position;

a tensioning mechanism operatively supported by said barrel and nose portions for tensioning said cable tie to a predetermined tension setting;

a trigger mounted to said housing for operating said tensioning mechanism; and an axially-reciprocating actuating rod having a first end operatively connected to said trigger and a second end communicating with said tensioning mechanism whereby operation of said trigger causes tensioning of said tie until said predetermined tension setting is achieved whereupon continued operation of said trigger causes axial movement of said nose portion with respect to said barrel portion thereby causing said blade to move from said first stowed position to said second cutting position thus severing an excess portion of said elongate tail from said cable tie without additional tensioning of said cable tie.

37. A method of reducing recoil in a cable tie installation tool, comprising:

providing a cable tie, said cable tie including a head and an elongate tail extending therefrom;

wrapping said cable tie about a bundle of articles and inserting said tail through said head, providing a tool, said tool including a housing, said housing operatively supporting a tensioning mechanism for tensioning said cable tie to a predetermined tension setting and a cutting mechanism for severing an excess portion of said tail from said tensioned cable tie, said tool further including a trigger mounted to said housing for operating said tensioning and cutting mechanisms;

tensioning said cable tie to said predetermined tension with said tool;

axially fixing said tensioning mechanism to said cutting mechanism upon reaching said predetermined tension whereby additional operation of said trigger does not produce additional tensioning of said cable tie; and operating said trigger to sever said excess portion of said tail from said cable tie without further tensioning of said cable tie.

* * * * *